US009463470B2

(12) United States Patent
Murahashi et al.

(10) Patent No.: US 9,463,470 B2
(45) Date of Patent: Oct. 11, 2016

(54) MAGNETIC-SEPARATION FILTER DEVICE

(75) Inventors: Kazuki Murahashi, Tokyo (JP); Kentarou Morita, Tokyo (JP); Yuzuru Kato, Tokyo (JP); Atsushi Murata, Tokyo (JP)

(73) Assignee: NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 492 days.

(21) Appl. No.: 14/001,590

(22) PCT Filed: Feb. 28, 2012

(86) PCT No.: PCT/JP2012/054896

§ 371 (c)(1),
(2), (4) Date: Aug. 26, 2013

(87) PCT Pub. No.: WO2012/118066

PCT Pub. Date: Sep. 7, 2012

(65) Prior Publication Data

US 2013/0327687 A1 Dec. 12, 2013

(30) Foreign Application Priority Data

Feb. 28, 2011 (JP) ..... 2011-041654

(51) Int. Cl.
*B03C 1/034* (2006.01)
*B03C 1/28* (2006.01)
*B03C 1/033* (2006.01)

(52) U.S. Cl.
CPC ..... *B03C 1/034* (2013.01); *B03C 1/0332* (2013.01); *B03C 1/288* (2013.01); *B03C 2201/18* (2013.01)

(58) Field of Classification Search
CPC ..... B03C 1/034; B03C 1/288; B03C 1/0032; B03C 2201/18
See application file for complete search history.

(56) References Cited

U.S. PATENT DOCUMENTS 4,664,796 A * 5/1987 Graham ..... B03C 1/033 210/222
6,596,182 B1 * 7/2003 Prenger ..... B03C 1/034 210/222

FOREIGN PATENT DOCUMENTS

JP 53-074411 6/1978
JP 58-143814 8/1983

(Continued)

OTHER PUBLICATIONS

International Search Report dated Jun. 26, 2012 issued in corresponding PCT Application No. PCT/JP2012/054896.

*Primary Examiner* — David A Reifsnyder
(74) *Attorney, Agent, or Firm* — Kenyon & Kenyon LLP

(57) ABSTRACT

Means for Solving the Problem

According to an aspect of the present invention, there is provided a magnetic-separation filter device that removes contaminants of fine ferromagnetic particles from a fluid containing such contaminants, comprising: a substantially cylindrical housing; two partition plates that are disposed in an inside of the housing so as to extend in a vertical direction of the housing, dividing the inside of the housing by being disposed in parallel to each other;

a filter medium that includes a fine amorphous-alloy wire bundle filled in a first region defined by the housing and the two partition plates; and plural permanent magnets that are provided on both sides of the first region outside the housing, wherein the contaminants of fine ferromagnetic particles are adsorbed on the filter media by flowing the fluid containing such contaminants through the first region in which the magnetic field has been formed by these plural permanent magnets.

10 Claims, 12 Drawing Sheets

(56) References Cited

FOREIGN PATENT DOCUMENTS

| | | |
|---|---|---|
| JP | 63-023707 | 2/1988 |
| JP | 63-501139 | 4/1988 |
| JP | 02-265688 | 10/1990 |
| JP | 04-225809 | 8/1992 |
| JP | 04-281807 | 10/1992 |
| JP | 04-317705 | 11/1992 |
| JP | 04-349908 | 12/1992 |
| JP | 06-254314 | 9/1994 |
| WO | 87/01608 | 3/1987 |

* cited by examiner

| No. | (4) | (5) |
|---|---|---|
| DETAILED LEVEL | NO MAGNETIC PATH AT AREA RATIO 1:7 | CENTER OF ELECTROMAGNETIC STEEL SHEET IS CUT AT AREA RATIO 1:7 |
| MAGNETIC FLUX DENSITY VECTOR (WHOLE) [T] |  |  |
| MAGNETIC FLUX DENSITY VECTOR (AMORPHOUS) [T] |  |  |
| MAGNETIC FLUX DENSITY CONTOUR (AMORPHOUS) [T] |  |  |

MAGNETIC-SEPARATION FILTER DEVICE

TECHNICAL FIELD

The present invention relates to a magnetic-separation filter device that can remove ferromagnetic inflow contaminants from a process fluid even under a high pressure and a high temperature in a process plant or the like.

This application is a national stage application of International Application No. PCT/JP2012/054896, filed Feb. 28, 2012, which claims priority to Japanese Application No. 2011-041654, filed Feb. 28, 2011, the content of which is incorporated herein by reference.

BACKGROUND ART

Iron powder and the like generated with machining or internal abrasion are suspended as contaminants of fine ferromagnetic particles in oils or liquids such as machine lubricant or machining oil. The oils or liquids including the contaminants cause problems such as a decrease in machine drive reliability and a decrease in machinability and cleaning efficiency. Accordingly, a filter device has been proposed which can remove contaminants of fine ferromagnetic particles from the oils or liquids. For example, a magnetic-separation oil purifier described in PTL 1 includes a filter medium formed of magnetic alloy and a magnetizer applying a magnetic field to the filter medium, in which fine amorphous-alloy wire bundle is used as the magnetic filter medium and a permanent magnet is used as the magnetizer.

In an oil purifier described in PTL 2, a magnet producing a magnetic field and a liquid-transmitting inner tube are disposed in an outer shield tube of a rectangular tubular shape.

CITATION LIST

Patent Literature

[PTL 1] Japanese Unexamined Patent Application, First Publication No. H4-349908

[PTL 2] Japanese Unexamined Patent Application, First Publication No. H6-254314

SUMMARY OF INVENTION

Problem to be Solved by the Invention

The magnetic-separation filter device is designed to remove contaminants of ferromagnetic particles from normal-temperature and normal-pressure oils such as a machine lubricant or machining oil and to reuse the processed oil in a clean state, but cannot be used directly to purify any high-pressure and a high-temperature liquid.

The present invention is made in consideration of the above-mentioned circumstances and an object thereof is to provide a magnetic-separation filter device which can be applied to high-pressure fluid as well as normal-pressure fluid and adsorb inflow contaminants of fine ferromagnetic particles with high efficiency.

Means for Solving the Problem

According to an aspect of the present invention, there is provided a magnetic-separation filter device including: a substantially cylindrical housing; a partition plate that partitions the inside of the housing; a filter medium that includes fine amorphous-alloy wire bundle and that is filled in a first region defined by the housing and the partition plate; and a permanent magnet that is arranged outside the housing so as to face each other across the first region, wherein a magnetic field is formed in the first region.

It is preferable that the magnetic-separation filter device according to the present invention further include a yoke as a return magnetic path that is formed of a material having high magnetic permeability and is connected to the permanent magnet.

It is preferable that the magnetic-separation filter device according to the present invention further include teeth that are formed of a material having high magnetic permeability and having no residual magnetism and be filled in the gap between the permanent magnet and the first region of the housing, and that a contact surface of the teeth and the permanent magnet be planar.

The magnetic-separation filter device according to the present invention further includes an on-off driver that causes the magnetizer to be configured with the permanent magnet and the yoke in close contact with the housing and to be separable from the housing.

The on-off control between close contact arrangement and separated arrangement of the permanent magnet and the york with respect to the housing by the on-off driver may be determined on the basis of one or more pieces of data on a magnetization time by a timer, a differential pressure between upstream and downstream of the filter medium, and an integrated flow volume of a fluid passing through the filter medium.

In the magnetic-separation filter device according to the present invention, it is preferable that a fluid including contaminants to be adsorbed on the filter medium at first descend in a second region defined by the housing and the partition plate and be reversed in flow direction there and then ascend in the first region.

Alternatively, a fluid including contaminants to be adsorbed on the filter medium may flow upward in the first region defined by the housing and the partition plate and filled with the fine amorphous-alloy wire bundle.

A part of the central portion of the teeth may be cut out. Alternatively, the teeth themselves may be removed so as to bring the permanent magnet into close contact with the housing.

One or more permanent magnets may be arranged to face each other across the first region of the housing defined by the partition plate.

The magnetic-separation filter device according to the present invention may further include plural magnetic-separation filters connected in parallel, and these plural magnetic-separation filters may be controlled so as to alternately transmit the backwash fluid at timings not overlapping with each other and to perform a filtration at continuous mode.

Advantageous Effects of the Invention

In the magnetic-separation filter device according to the present invention, the first region defined by the substantially cylindrical housing and the partition plate is filled with the filter medium formed of fine amorphous-alloy wire bundle and the permanent magnet is disposed as a magnetizer at a position outside the housing opposed to the first region to form a magnetic field in the first region.

Accordingly, since pressure resistance can be guaranteed by the cylindrical housing, the magnetic-separation filter device can be applied to a high-pressure fluid as well as a normal-pressure fluid. Since a magnetic path is formed in the first region defined by the parallel partition plate, a magnetic flux of the opposed permanent magnet is not spread to the outside from the first region and a high-level parallel magnetic field without leakage of a magnetic field is uniformly formed, contaminants of fine ferromagnetic particles included in the fluid can be adsorbed on the fine amorphous-alloy wire bundle.

Since the permanent magnet is connected to the yoke formed of a material having high magnetic permeability as the magnetizer, it is possible to construct a closed magnetic path without loss and the first region and thus to uniformly form a high-level magnetic field in the first region.

Since the teeth formed of a material having no residual magnetism with high permeability are filled in the gap between the permanent magnet and the first region of the housing and the contact surface of the teeth and the permanent magnet is planar, the teeth and the permanent magnet come in close contact with each other at the contact surface to reduce magnetic loss and to eventually ensure easy attachment and detachment of the magnetizer including the permanent magnet.

Since the magnetic-separation filter device includes the on-off driver that causes the magnetizer to be configured with the permanent magnet and the yoke, in close contact with the first region of the housing and to be separable from the housing, the magnetic field in the first region disappears and the magnetic field gradient of the fine amorphous-alloy wire bundle disappears to remove the adsorptive force of fine ferromagnetic particles and to perform other operations such as backwashing, by separating the magnetizer from the housing to a separately-evacuated position to turn off the magnetization. At this time, since the residual magnetic flux density of the fine amorphous-alloy wire bundle is low, the adsorptive force is close to zero and thus the backwashing can be easily performed. Thereafter, by arranging the magnetizer in close contact with the first region of the housing to turn on the magnetization, a magnetic field is formed in the first region to generate an adsorptive force of fine ferromagnetic particles by the magnetic field gradient of the fine amorphous-alloy wire bundle. Thereby the contaminants of fine ferromagnetic particles are captured and adsorbed.

The on-off control between close contact arrangement and separated arrangement of the magnetizer in relation to the permanent magnet and the york is determined on the basis of one or more pieces of data on a magnetization time by a timer, a differential pressure between upstream and downstream of the filter medium, and an integrated flow volume of a fluid passing through the filter medium. Accordingly, it is possible to adsorb contaminants in the fluid and it is possible to stop the operation of adsorbing contaminants at an appropriate time and to perform other operations such as backwashing, while appropriately retarding clogging of the magnetic-separation filter at the time of the magnetization on-off control between the closely-opposed arrangement and the separately-evacuated arrangement of the magnetizer by the on-off driver. As a result, it is possible to prevent clogging trouble and to extend the maintenance intervals.

In the magnetic-separation filter device according to the present invention, since the housing is partitioned into the first region filled with the fine amorphous-alloy wire bundle and the second region by the partition plate, a magnetic field is hardly formed in the second region, which can be used as fluid flow inlet channel. In this case, the fluid, descending at first in the second region along the partition plate, is reversed at the lower end thereof, and then ascends in the first region. Accordingly, it is possible to separate by inertia-gravity precipitation some contaminants of particles in the fluid at the flow direction reversing time of the descending fluid and thus to reduce the load on the filter medium.

Since the fluid including contaminants at first flow upward in the first region, such contaminants of particles in the fluid slip due to the gravitational force and are separated by precipitation or ascend at a rate slower than the fluid flow rate, the load on the filter medium can be reduced and the filtration efficiency can be improved.

A part of the central portion of the teeth is cut out. Where the teeth are formed of a laminated electromagnetic steel sheet and magnetic resistance of the bonding surface between the teeth and the housing is large, a magnetic flux is likely to leak along the shape of the electromagnetic steel sheet. However, where a part of the central portion of the magnetic path is cut out, it is possible to prevent leakage of a magnetic flux and thus to equalize the magnetic flux density distribution.

Since one or more permanent magnets are arranged to oppose the first region of the housing defined by the partition plate, it is possible to increase or decrease the strength of the magnetic field formed in the first region.

Plural magnetic-separation filters may be connected in parallel and the magnetic-separation filters may be controlled such as to alternately transmit the backwash fluid at timings not overlapping with each other and to perform a filtration at continuous mode.

Where plural magnetic-separation filter devices are connected in parallel to a single controller, it is possible to treat the continuous flow of a fluid by controlling the magnetic-separation filter devices so as to alternately perform backwashing at timings not overlapping each other.

MODE FOR CARRYING OUT THE INVENTION

Hereinafter, a magnetic-separation filter device according to an embodiment of the present invention will be described with reference to the accompanying drawings.

Figure 1:
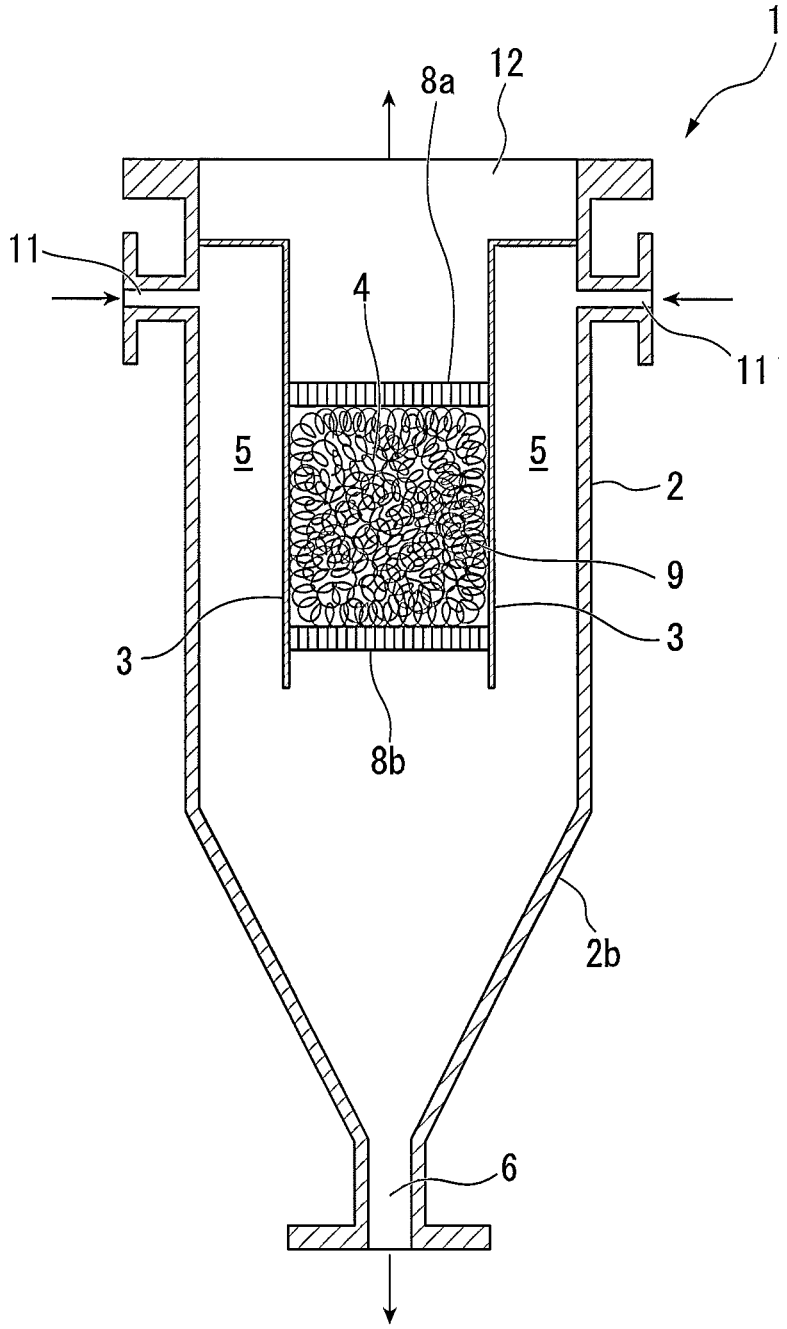
FIG. 1 is a longitudinal cross-sectional view illustrating a part of a magnetic-separation filter device according to an embodiment of the present invention.
Figure 2:
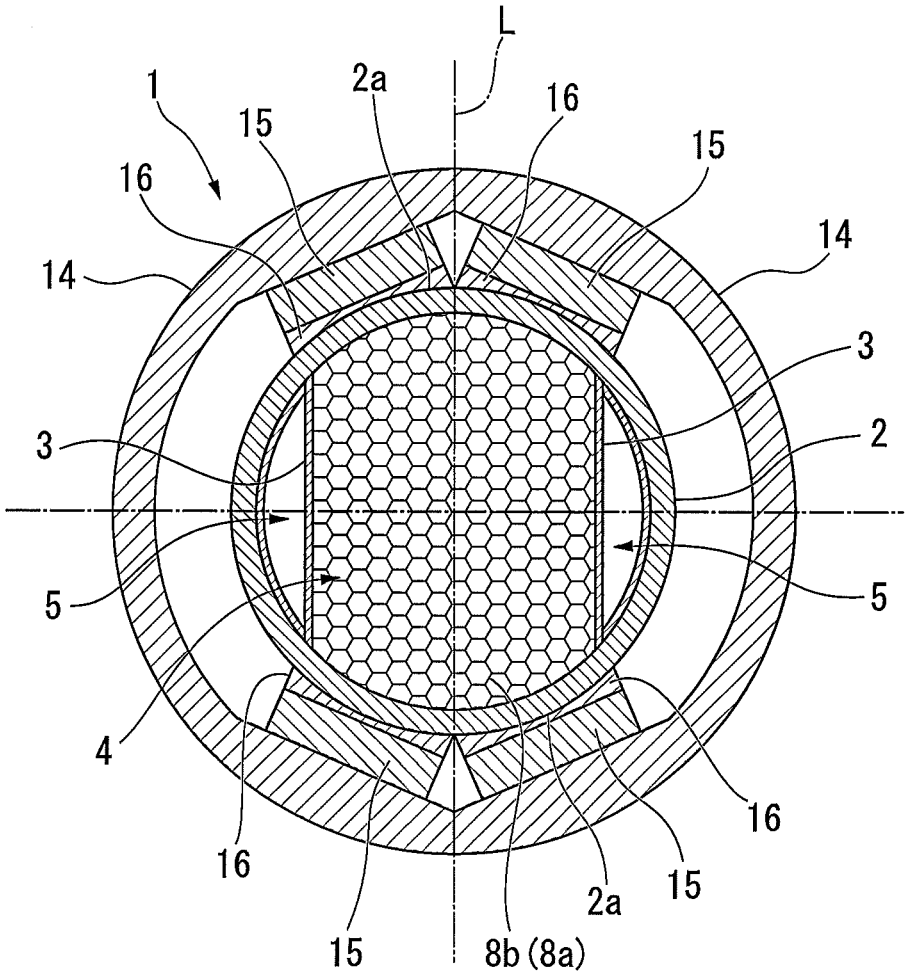
FIG. 2 is a horizontal cross-sectional view illustrating a part of the magnetic-separation filter device shown in FIG. 1.

In a magnetic-separation filter device 1 shown in FIGS. 1 and 2, a partition plate 3 formed of nonmagnetic metal and including a pair of substantially parallel plates extends downward in a substantially cylindrical housing 2 arranged in the vertical direction. The lower end of the partition plate 3 has a length equal to or less than the lower end of the trunk of the housing 2. The upper end of the partition plate 3 is bent to the outside at a substantially right angle and is locked to and closed by the circumferential surface of the housing 2. The housing 2 is formed of nonmagnetic metal like a SUS tube and is formed of, for example, a thick tube of sch80 or the like so as to withstand a high pressure.

In the housing 2, a substantially elliptical first region defined by the pair of partition plates 3 and arc-like portions 2*a* of the housing 2 constitutes an inner region 4, and a pair of substantially arc-like second regions arranged on both sides of the inner region 4 with the partition plate 3 interposed therebetween constitutes an outer region 5. The inner region 4 and the outer region 5 are partitioned from each other in order for a fluid not to converge within a range in which the partition plate 3 is disposed. The ratio of the total horizontal cross-sectional area of the two outer regions 5 and the horizontal cross-sectional area of the inner region 4 ranges from 1:5 to 1:100.

The lower part of the housing 2 is formed as a hopper portion 2*b* whose diameter tapers off and a backwash liquid outlet 6 configured to discharge a backwash liquid is formed at the lower end thereof.

A pair of support fittings 8*a* and 8*b* including a grating formed of nonmagnetic metal such as stainless steel is disposed at the upper end and the lower end of the inner region 4 of the housing 2. The inner region 4 interposed between two partition plates 3 and between the support fittings 8*a* and 8*b* is filled with fine amorphous-alloy wire bundle 9 having high permeability and small residual magnetism.

In the upper part of the housing 2, an inlet 11 of fluids such as oil is formed below the bent portion of the partition plate 3. The inlet 11 communicates with the outer region 5 in the housing 2. In FIG. 1, two inlets 11 are disposed to oppose each other, but the number of inlets 11 may be determined as appropriate as long as the fluid is allowed to flow in the outer region 5. A fluid outlet 12 of a fluid is formed at the upper end of the housing 2.

A magnetizer will be described below with reference to FIG. 2.

In FIG. 2, a yoke 14 constituting a return magnetic path not shown in FIG. 1 is disposed outside the housing 2. The yoke 14 is formed substantially in a semi-cylindrical shape by laminating a substantially semicircular electromagnetic steel sheets and a pair of yokes 14 having a substantially semi-cylindrical shape is opposed to each other so as to surround the housing 2. It is preferable that the housing 2 and the pair of yokes 14 be arranged coaxially.

Permanent magnets 15 are fixed inward in the diameter direction at both ends of each of the yokes 14. Outside arc-like portions 2*a* defined by the pair of partition plates 3 in the housing 2, teeth 16 formed of a laminated electromagnetic steel sheet having high permeability and small residual magnetism are fixed as a magnetic path to the housing. The permanent magnets 15 of the yokes 14 and the teeth 16 come in close surface contact with each other.

In FIG. 2, the partition plates 3 may be formed outside arc-like portions of the housing 2 in addition to the parallel plates disposed between the outer ends of the two teeth 16 opposing each other. Accordingly, the outer region 5 is formed to be surrounded with the partition plates 3 formed of nonmagnetic metal in an arc shape.

In the example shown in FIG. 2, a high uniform magnetic field is formed in the inner region 4 of the housing 2 via the permanent magnets 15 and the teeth 16 formed at both ends of a substantially semicircular return magnetic path (yoke) 14 partitioned by a virtual center axis L of the housing 2, and a magnetic field is hardly formed in the outer regions 5 defined by the partition plates 3. Accordingly, the ends of the partition plates 3 are located at the outer ends of the permanent magnets 15 and the teeth 16 and the outer region 5 can be constructed as a fluid inflow channel.

A magnetic field gradient is formed in the fine amorphous-alloy wire bundle 9 by the magnetic field in the inner region 4 of the housing 2 and ferromagnetic contaminants in the fluid are adsorbed accordingly. Examples of the ferromagnetic contaminants to be adsorbed include iron, nickel, and cobalt.

The two yokes 14, the permanent magnets 15, and the teeth 16 disposed on both sides of the virtual line L may come in contact with each other or may be separated from each other. As shown in FIG. 2, the device is symmetric on the virtual line L and there is no magnetic flux crossing the virtual line L. Accordingly, although the yokes 14 are substantially divided into two semi-circles, there is no loss of magnetic flux and thus the yokes 14 can be separated into the separately-evacuated arrangement.

Figure 3:
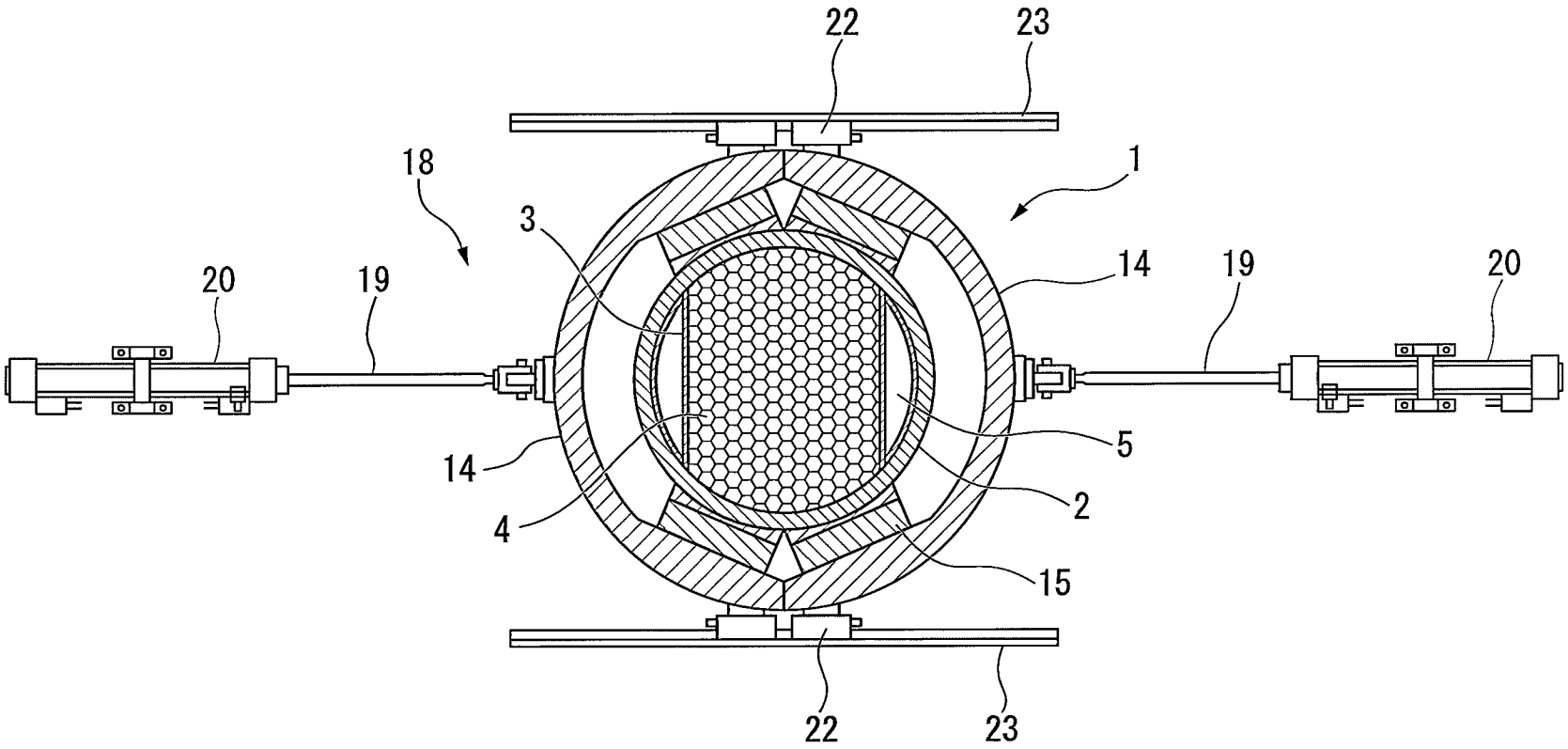
FIG. 3 is a horizontal cross-sectional view illustrating a switching driver of a magnetic-separation filter device according to an embodiment in a magnetization ON state in which a magnetizer is closely arranged to be opposed.
Figure 4:
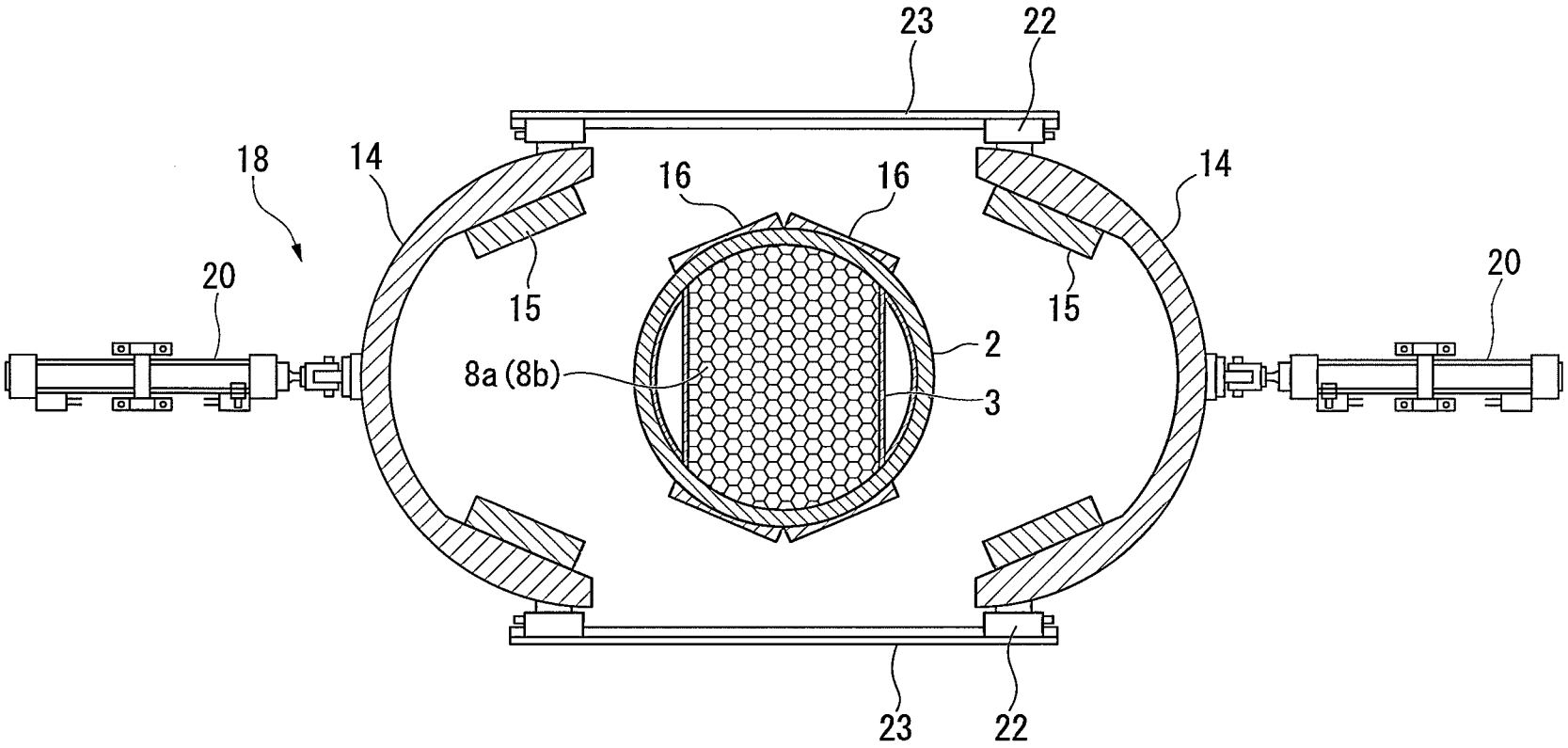
FIG. 4 is a horizontal cross-sectional view illustrating a switching driver of a magnetic-separation filter device according to an embodiment in a magnetization OFF state in which a magnetizer is separately arranged to be evacuated.

As shown in FIGS. 3 and 4, the magnetic-separation filter device 1 can be divided by the substantially semicircular yokes 14 having the permanent magnets 15 disposed at both ends thereof and is provided with a switching driver 18 that opens and closes the yokes 14.

An air cylinder 20 is connected, for example, to the central portion of each substantially semicircular yoke 14 with a rod 19 interposed therebetween. By causing the rod 19 to expand and contract by turning on and off the air cylinder 20, the permanent magnets 15 disposed in the yoke 14 can come in close contact with and be separated from the teeth 16 fixed to the arc-like portions 2*a* of the housing 2. Slides 22 are connected to both ends of each yoke 14 and each slide 22 is guided by a guide rail 23 disposed substantially in parallel on both sides of the magnetic-separation filter device 1 so as to go forward and backward.

Accordingly, at the time of magnetization OFF in which the magnetizer is separately arranged in the magnetic-separation filter device 1, as shown in FIG. 4, the rods 19 are pushed to contract by the pair of air cylinders 20 to separate the magnetizer including the pair of yokes 14 and the permanent magnets 15 from the teeth 16. At the time of closing, as shown in FIG. 3, the rods 19 are pulled to expand by the pair of air cylinders 20 to bring the magnetizer including the pair of yokes 14 and the permanent magnets 15 into close contact with the teeth 16.

Figure 5:
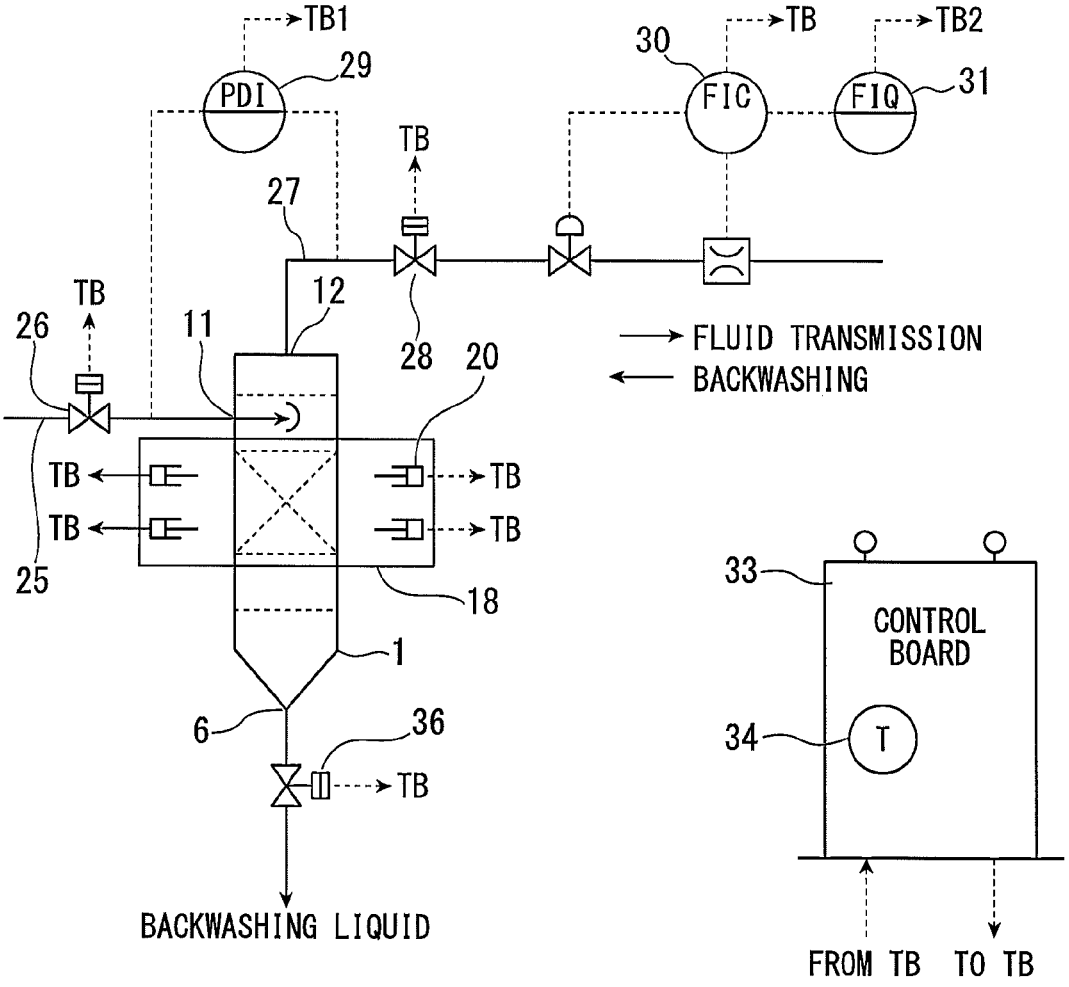
FIG. 5 is a diagram illustrating a flow channel configuration of the magnetic-separation filter device.

The flow channel configuration of the magnetic-separation filter device 1 shown in FIG. 5 will be described below.

An inlet on-off valve 26 is disposed in an inlet flow channel 25 communicating with the inlet 11 in the housing 2 of the magnetic-separation filter device 1. An outlet on-off valve 28 is disposed in an outlet flow channel 27 communicating with the outlet 12 of the housing. When the flow rate of a fluid in the inner region 4 of the housing 2 is excessively high, its adsorption is difficult. Accordingly, the flow rate of a fluid is controlled within an appropriate range by adjusting the flow rate discharged from the outlet 12 with the outlet on-off valve 28, thereby efficiently adsorbing ferromagnetic contaminants on the fine amorphous-alloy wire bundle 9 as a medium filter.

A filter differential pressure meter 29 is disposed between the inlet flow channel 25 on the upstream side of the inlet 11 and the outlet flow channel 27 on the downstream side of the outlet 12. In the outlet flow channel 27, a flow controller 30 holding the flow volume of the outlet channel 27 in an appropriately range is disposed on the downstream side of the outlet on-off valve 28, in combination with an integration flowmeter 31 integrating the flow volume passing through the flow controller 30.

The differential pressure detected by the filter differential pressure meter 29 is output as data TB1 to a controller 33. An integrated flow volume of a fluid flowing in the inner region 4 having the fine amorphous-alloy wire bundle 9 built therein in the housing 2 is measured by the integration flowmeter 31 and is output as data TB2 to the controller 33. The controller 33 is provided with a timer 34 that measures a fluid transmission time of the magnetic-separation filter device 1 and the measured drive time is output as data TB3.

In a tapered portion 2*b* of the housing 2, an on-off valve 36 is disposed in a flow channel on the downstream side of a backwash liquid outlet 6 configured to discharge a backwash liquid.

Figure 6:
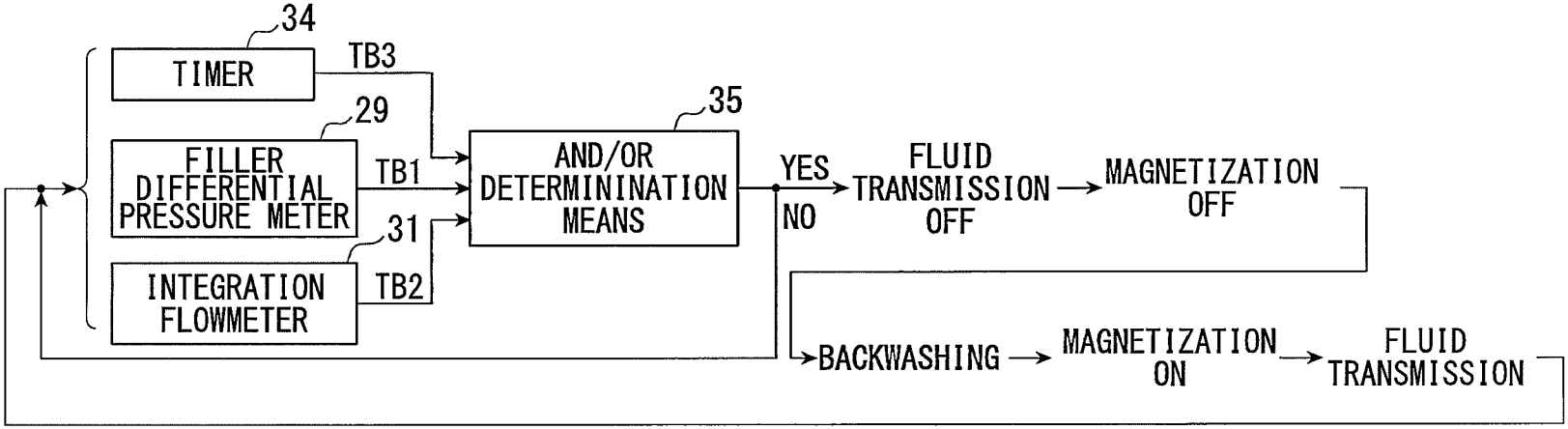
FIG. 6 is a diagram illustrating a switching control procedure of the magnetic-separation filter device.

In FIG. 6, data TB1, TB2, and TB3 are input to determination section 35 comprising the controller 33, and a stop signal from the magnetic-separation filter device 1 when the determination section 35 determines at least one, or two, or three pieces of preset data TB1, TB2, and TB3 as exceeding the respective predetermined reference values.

In response to this stop signal, the inlet on-off valve 26 is turned off, and the on-off driver 18 is driven to evacuate the permanent magnets 15 and the yokes 14 to a position separated from the teeth 16. In this state, the backwash liquid is turned to flow in the fine amorphous-alloy wire bundle 9 filled in the inner region 4 of the housing 2 in the reverse direction, for example, from the outlet 12 to the backwash liquid outlet 6 to perform the backwashing.

In this way, it is possible to detect the degree of clogging in the inner region 4 and the backwash timing of the fine amorphous-alloy wire bundle 9 per the data TB1, TB2, and TB3 from the filter differential pressure meter 29, in combination with the integration flowmeter 31, and the timer 34. After the washing ends, the filter differential pressure meter 29, the integration flowmeter 31, and the timer 34 are reset to restart the fluid transmission. Where two or more magnetic-separation filter devices 1 are controlled by a single controller 33, it is possible to treat the continuous flow of a fluid by controlling the backwash timing of each device such as to allow for the individual alternate operation at non-overlaping mode.

The magnetic-separation filter device 1 according to this embodiment has the above-mentioned configuration and a method of adsorbing ferromagnetic contaminants on the magnetic-separation filter device 1 will be described below.

As shown in FIGS. 1 and 2, in the magnetic-separation filter device 1 in which the permanent magnets 15 of the yokes 14 are brought into close contact with the teeth 16 by the on-off driver 18, for example, when oil into which iron powder is mixed as contaminants is introduced as a fluid from the inlet 11 disposed in the housing 2, the oil flows downward in the outer region 5 defined by the substantially-cylindrical circumferential surface of the housing 2 and the partition plates 3. A magnetic field due to the permanent magnets 15 is hardly generated in the outer region 5.

The flow of oil is reversed at the lower end of the partition plates 3 by a pump, although not shown and the oil ascends in the inner region 4 defined by the pair of partition plates 3. At this time, some contaminants of iron powder or the like having a relatively large weight in the oil reversed upward are separated by precipitation due to downward flow inertia and gravity and descend toward the tapered portion 2*b*. Accordingly, since the filtration load of the fine amorphous-alloy wire bundle 9 is reduced, it is possible to extend the backwash intervals.

In the inner region 4 defined by the partition plates 3 of the housing 2, a high magnetic field is uniformly generated between the permanent magnets 15 and the teeth 16 opposed to each other at both ends of each of the yokes 14 and thus iron powder or the like in the oil ascending in the inner region 4 is adsorbed on the fine amorphous-alloy wire bundle 9 due to the magnetic field gradient generated in the fine amorphous-alloy wire bundle 9 filled in the inner region 4.

Here, the area ratio of the outer region 5 relative to the inner region 4 in the housing 4 is set to a range of 1:5 to 1:100. Then, for example, where the linear velocity of the oil descending in the outer region 5 ranges from 0.75 m/s to 1.0 m/s, the linear velocity of the oil ascending in the inner region 4 ranges from 0.01 m/s to 0.05 m/s, which is a flow profile suitable for the magnetic adsorption on the fine amorphous-alloy wire bundle 9.

When the predetermined time elapses, the amount of ferromagnetic contaminants such as iron powder adsorbed on the fine amorphous-alloy wire bundle 9 in the inner region 4 of the housing 2 increases to raise in turn the flow resistance of the oil ascending in the inner region 4. Accordingly, as shown in FIGS. 5 and 6, the differential pressure, which is detected by the filter differential pressure meter 29, between the hydraulic pressure on the inlet flow channel 25 side and the hydraulic pressure on the outlet flow channel 27 side increases, and the determination section 35 of the controller 33 detects the data TB1 output from the filter differential pressure meter 29 as exceeding the predetermined reference value. In the same manner, the determination section 35 detects the data TB2 output from the integration flowmeter 31 and the data TB3 output from the timer 34 as exceeding the respective predetermined reference values.

In this case, by causing the determination section 35 to detect one or more pieces of preset data TB1, TB2, and TB3 as exceeding the respective predetermined reference values, the on-off valve 26 of the inlet flow channel 25 is closed to turn off the transmission of the oil from the inlet 11 to the outer region 5 in response to a signal output from the controller 33.

By turning on the pair of air cylinders 20 of the on-off driver 18 shown in FIG. 3 to cause the rods 19 to contract, the yokes 14 are separated from the housing 2 as shown in FIG. 4. Accordingly, the permanent magnets 15 disposed at both ends of each of the yokes 14 are separated from the teeth 16 fixed to the arc-like portions 2*a* of the housing 2.

The magnetization of the fine amorphous-alloy wire bundle 9 in the inner region 4 of the housing 2 is turned off. Accordingly, the transmission of the oil is stopped and the adsorption of ferromagnetic contaminants in the oil is stopped.

In this state, the backwash liquid flows in the inner region 4 via the outlet 12 of the housing 2 from the outlet flow channel 27 to wash out the ferromagnetic contaminants such as iron powder adsorbed on the fine amorphous-alloy wire bundle 9 in a demagnetized state.

Then, the backwash liquid including the ferromagnetic contaminants such as iron powder is discharged from the lower tapered portion 2*b* of the housing 2 through the backwash liquid outlet 6 and the on-off valve 36 at open position.

By driving the air cylinders 20 of the on-off driver 18 to cause the rods 19 to expand in response to the ON signal from the controller 33 after the predetermined duration of backwashing, the yokes 14 move so as to switch the state where the permanent magnets 15 are separated from the teeth 16 of the housing 2 as shown in FIG. 4 to the state where the permanent magnets 15 come in close contact with the teeth 16 as shown in FIG. 3. In this state, the magnetic-separation filter device 1 is turned on in magnetization to form a magnetic field in the fine amorphous-alloy wire bundle 9 in the inner region 4.

By opening the on-off valve 26 of the inlet flow channel 25, oil flows in the outer region 5 of the housing 2.

As described above, by forming the housing 2 in a substantially cylindrical shape, the magnetic-separation filter device 1 according to this embodiment can be applied to fluids such as high-pressure oil. Since the partition plates 3 including parallel plates are arranged in the housing 2 to oppose each other and the inner region 4 defined by the partition plates 3 is filled with the fine amorphous-alloy wire bundle 9 to form a magnetic field, the magnetic field is high and uniform and the diameter of the inner region 4 can be made larger. In addition, since a magnetic field is hardly formed in the outer region 5 of the housing 2, the outer region can be used as an inlet flow channel of oil.

Since the inflow oil to the housing 2 descending in the outer region 5 partitioned from the inner region 4 by the partition plates 3 from the inlet 11, is reversed at the lower end of the partition plates 3, and ascends in the inner region 4, some contaminants such as iron particles can be separated in advance by inertia-gravity precipitation at the time of reversing the direction and it is thus possible to reduce the filtration load on the fine amorphous-alloy wire bundle 9.

By setting the area ratio of the outer region 5 relative to the inner region 4 to a range of 1:5 to 1:100, the flow rate of oil in the inner region 4 in which the adsorption is carried out can be set to such a lower rate as suitable for the adsorption of nonmagnetic contaminants such as iron powder.

By disposing the tapered portion 2*b* in the lower part of the housing 2, it is possible to ensure the stable backwashing when the backwash liquid flows downward.

The yoke 14 having the permanent magnets 15 fixed thereto can be divided into two parts in a portion having no magnetic flux. In addition, by forming the contact surface of the teeth 16 fixed to the housing 2 and the permanent magnets 15 in a planar shape, it is possible to reduce magnetic loss.

In the related art, the permanent magnets of the magnetic-separation filter device is manually attached to and detached from the housing. However, in the magnetic-separation filter device 1 according to this embodiment, based on the measurements by instruments such as filter differential pressure meter 29, the integration flowmeter 31 and the timer 34, the backwash timing can be determined by the determination section 35. This makes it possible to automatically attach and detach the magnetizer in relation to the permanent magnets 15 and the yokes 14 with respect to the housing 2 by the use of the on-off driver 18. The on-off driver 18 is of a simple mechanism using the air cylinders 20 and is capable of automatic control over the on-off of the magnetization and the backwashing based on at least one or more pieces of data of the filter differential pressure meter 29, the integration flowmeter 31, and the timer 34. This ensures the stable backwashing and the extended maintenance intervals even at continuous mode. By controlling two or more magnetic-separation filter devices 1 by a single controller 33, it is possible to treat the continuous flow of a fluid.

The present invention is not confined to the configuration of the magnetic-separation filter device 1 according to the embodiment but may be appropriately modified in various forms without departing from the concept of the present invention.

Figure 7:
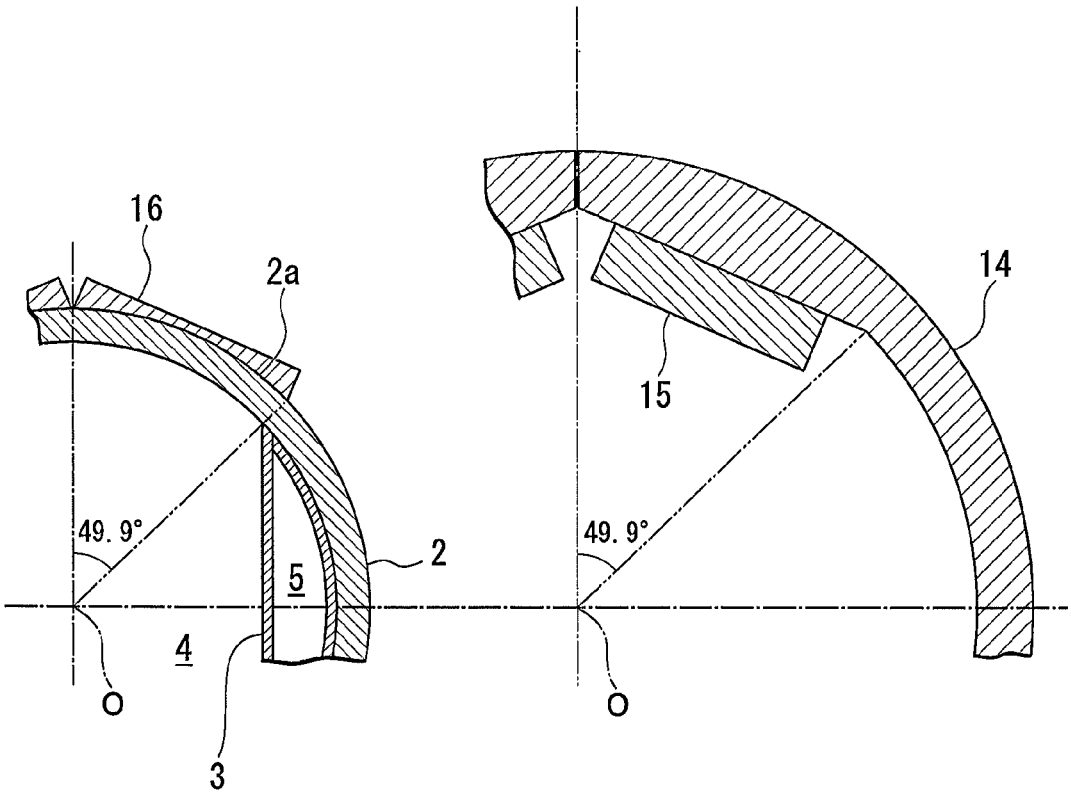
FIG. 7 is a cross-sectional view illustrating a magnetic path, permanent magnets, and a return magnetic path in a housing in a separated state.

FIG. 7 shows the relationships between the teeth 16, the partition plates 3 in the housing 2 and the permanent magnets 15 disposed at both ends of the yokes 14 in the magnetic-separation filter device 1. In FIG. 7 where the area ratio in the horizontal cross-section of the outer region 5 relative to the inner region 4 of the substantially cylindrical housing 2 is set to 1:7, the angular range from the center O of the housing 2 to both ends of the magnetic path (teeth) 16 is 46.2 degrees. Where the area ratio of the outer region 5 relative to the inner region 4 is set to 1:10, the angular range to both ends of the magnetic path 16 is 49.9 degrees (see FIG. 7). Where the area ratio of the outer region 5 relative to the inner region 4 is set to 1:20, the angular range to both ends of the magnetic path 16 is 55.7 degrees.

By setting the area ratio in this way, the magnetic flux having the width corresponding to the width of the teeth 16 which is in close contact with the permanent magnet 15 passes in parallel through the fine amorphous-alloy wire bundle 9 in the inner region 4 of the housing 2 approximately defined by the partition plates 3 without magnetic loss between the two permanent magnets 15 disposed at both ends of each yoke 14.

Since the magnetic flux is not spread to the outside of the partition plates 3, a uniform magnetic field is formed in the inner region 4. On the other hand, where the partition plates 3 are not provided, the magnetic flux is spread to the outside, which is not desirable.

Figure 8:
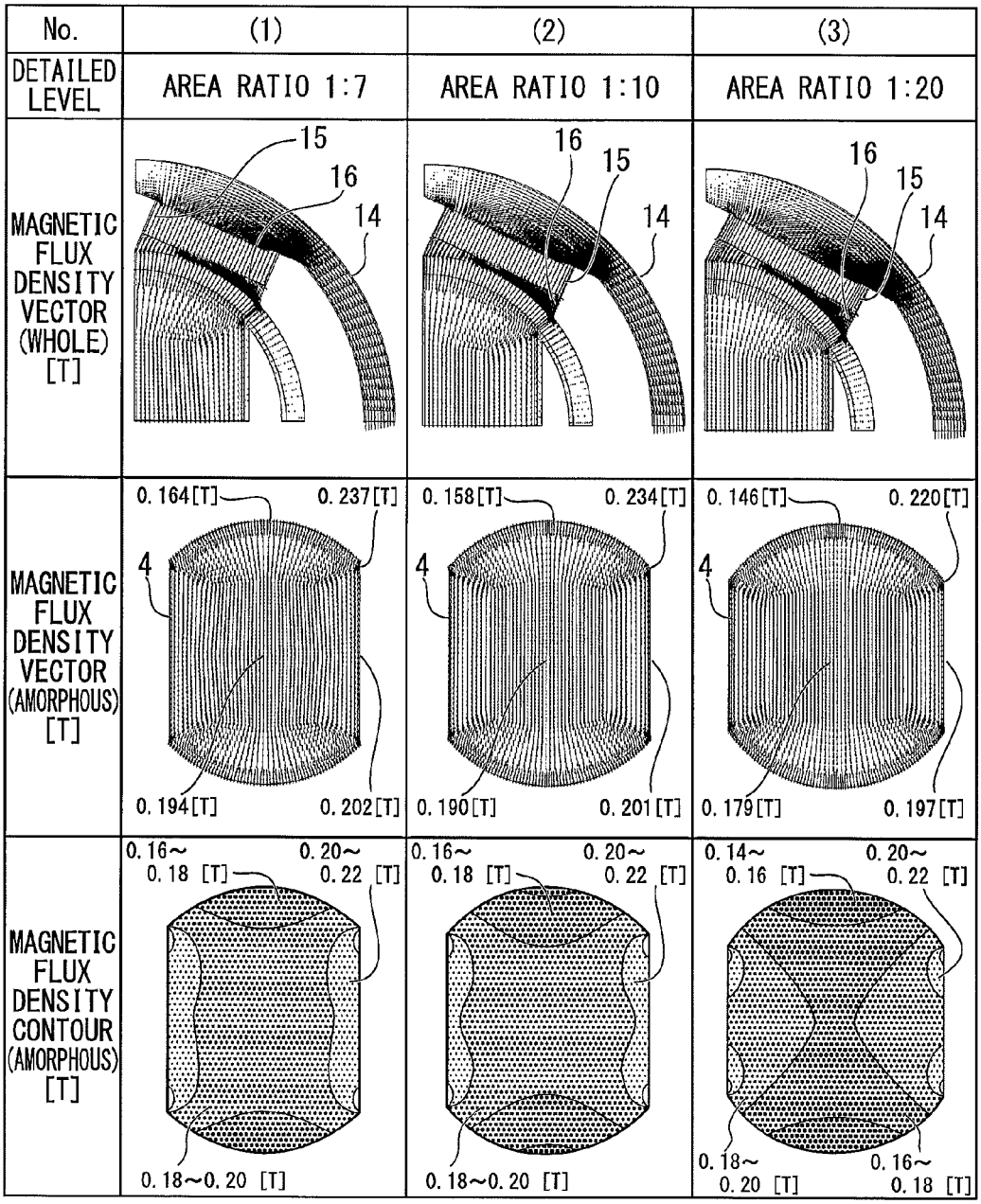
FIG. 8 is a diagram illustrating vectors and contours of a magnetic flux density in the housing depending on the configuration of permanent magnets and magnetic paths.
Figure 9:
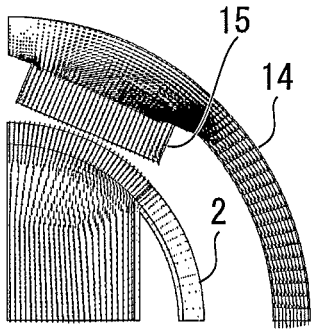
FIG. 9 is a diagram illustrating vectors and contours of a magnetic flux density in the housing depending on the configuration of permanent magnets and magnetic paths.
Figure 9:
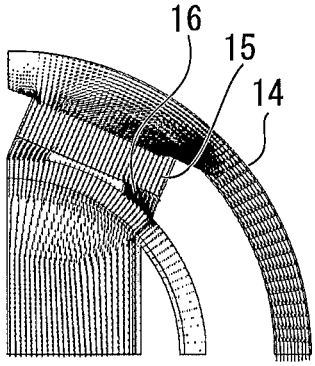
Figure 9:
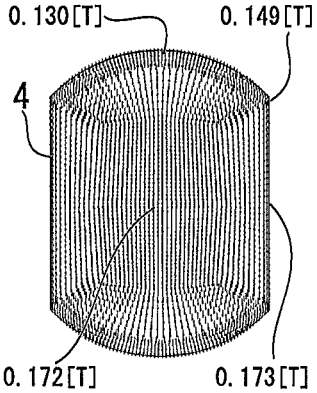
Figure 9:
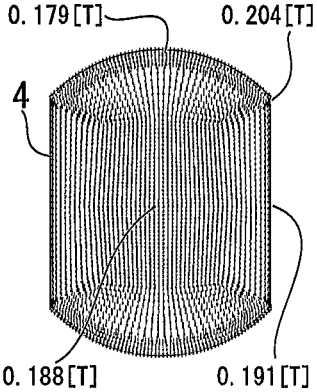
Figure 9:
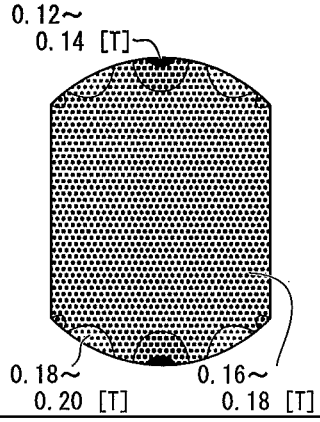
Figure 9:
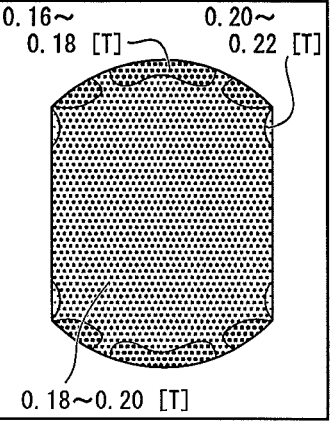
Figure 10:
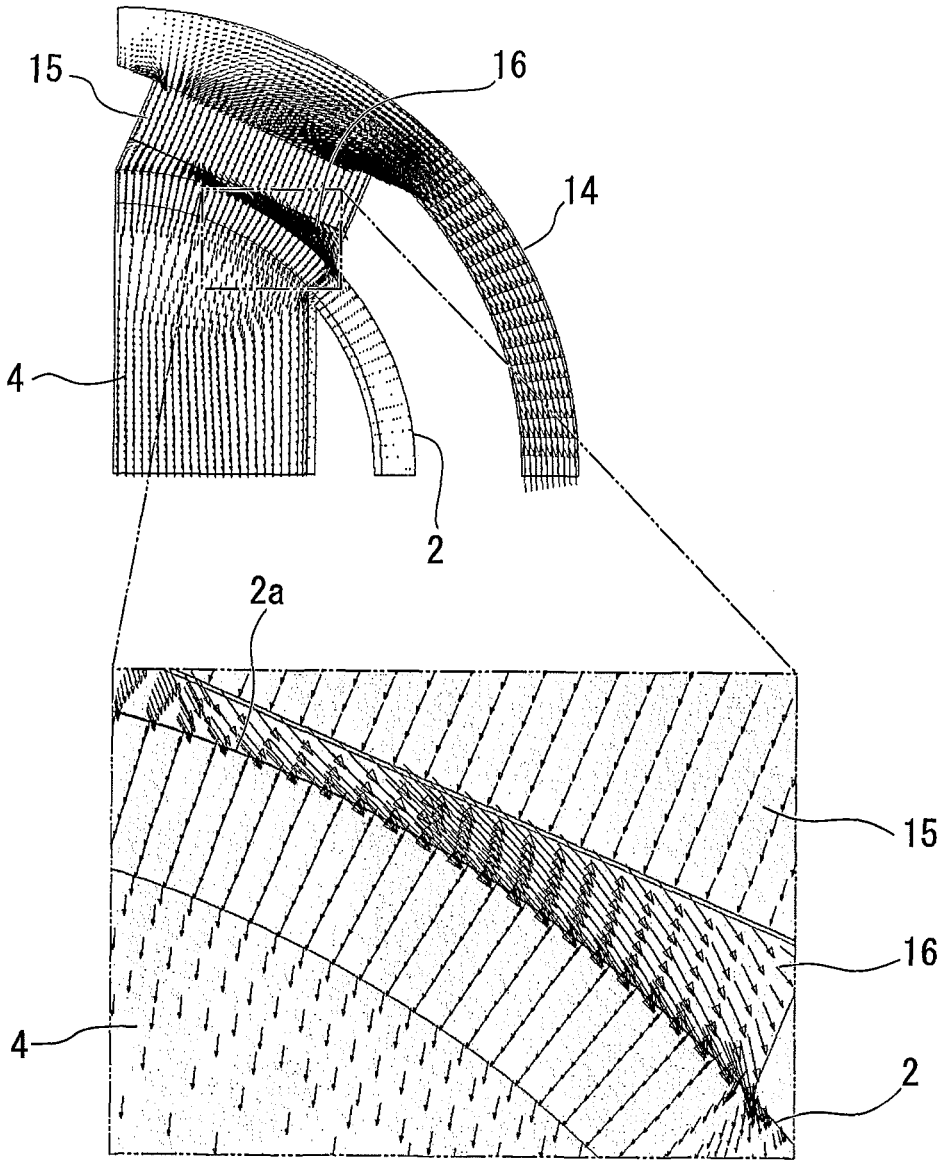
FIG. 10 is a diagram illustrating vectors (all) of a magnetic flux density flowing in an inner region of the housing via teeth from a permanent magnet in (1) of FIG. 8.

In an example of the magnetic-separation filter device 1, simulation results on the magnetic field in the magnetizer and the inner region 4 in the housing 2 depending on the area ratio of the outer region 5 relative to the inner region 4 are shown in FIGS. 8 to 10.

In FIGS. 8 and 9, (1) when the area ratio of the outer region 5 relative to the inner region 4 is set to 1:7, the magnetic flux straightly moves from the permanent magnet 15 and the teeth 16 to the inner region 4 but the magnetic flux tends to flow to the outside in the width direction in the teeth 16 (see FIG. 10) because the teeth 16 formed of a laminated electromagnetic steel plate has small magnetic resistance. Accordingly, the magnetic flux is likely to flow to the outer end of the magnetic path 16 and then to flow into the inner region 4. (2) and (3) Where the area ratio is set to 1:10 and 1:20, the same tendency is exhibited, but the magnetic field strength in the inner region 4 is slightly lower than that in (1) where the area ratio is set to 1:7.

(4) Where the area ratio is set to 1:7 and the teeth 16 fixed to the housing 2 is removed, the magnetic field in the inner region 4 becomes lower than that in (1) but the lowered magnitude is small. Accordingly, it is demonstrated that the teeth 16 can be dispensed with. (5) Where the area ratio is set to 1:7, the teeth 16 formed of a laminated electromagnetic steel sheet is formed at only both ends at which the gap between the permanent magnets 15 and the housing 2 is large, and the middle therebetween is formed as an empty space, it is possible to prevent the magnetic flux from flowing to the outside in the width direction in the teeth 16 and thus to equalize the magnetic flux density distribution. In (5), the magnetic flux density is minutely lower than in (1) as a whole, but the magnetic flux density at both ends in the length direction of the inner region 4 increases (0.179 T) and the magnetic flux density is equalized in the whole cross-section.

Figure 11A:
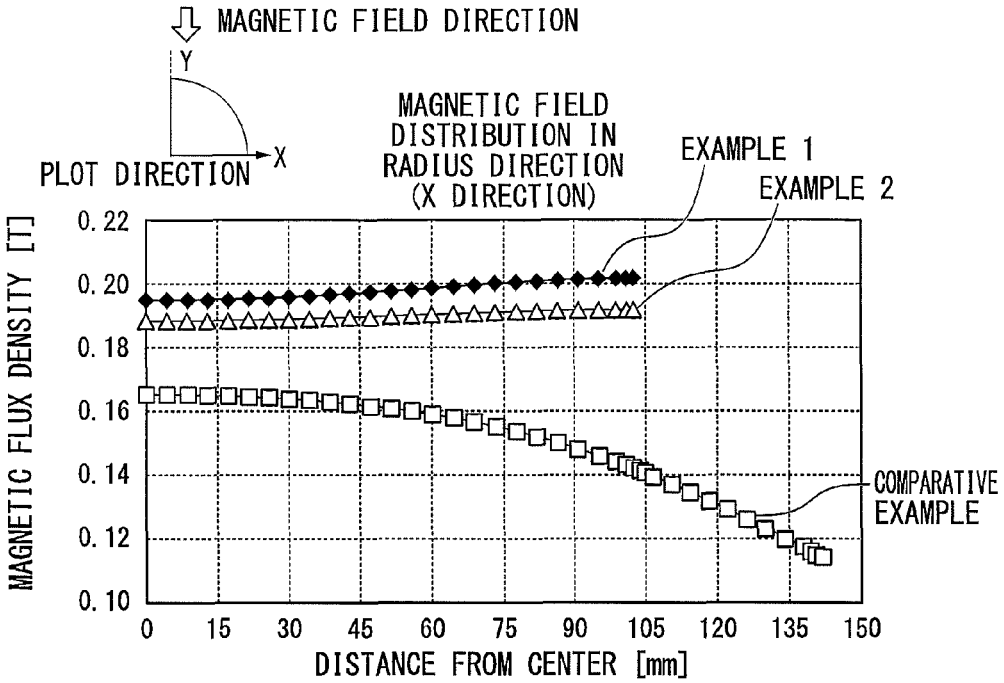
FIG. 11 is a graph illustrating a relationship between the distance from the center and the magnetic flux density in Example 1, Example 2, and a comparative example depending on presence or absence of a partition plate in the housing, where FIG. 11(*a*) illustrates a magnetic flux density in the radius direction and FIG. 11(*b*) illustrates a magnetic flux density in the length direction.
Figure 11B:
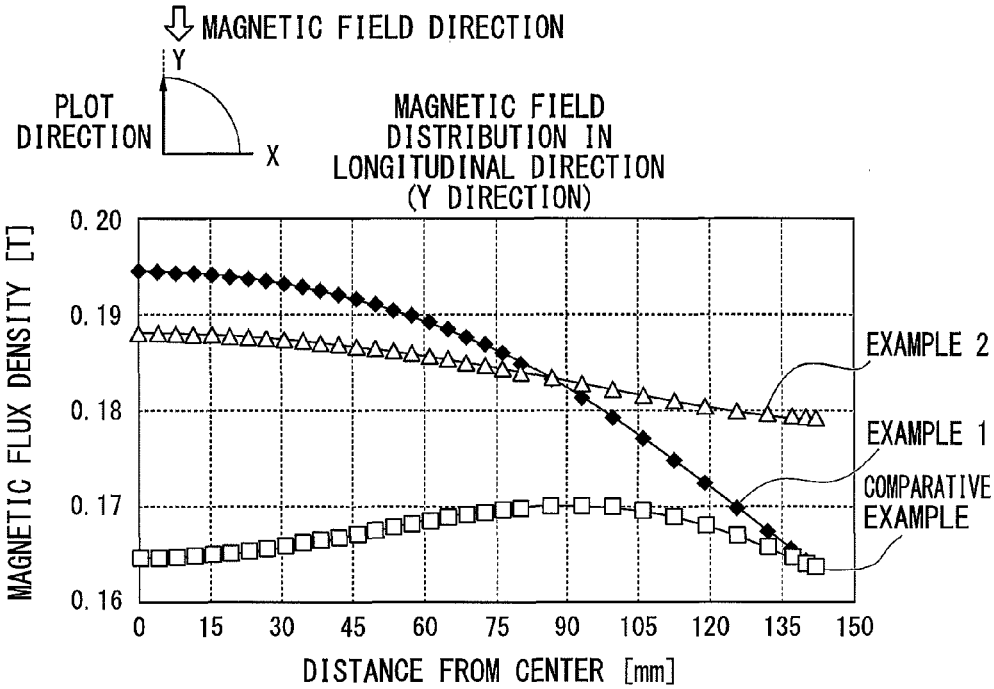
Figure 12:
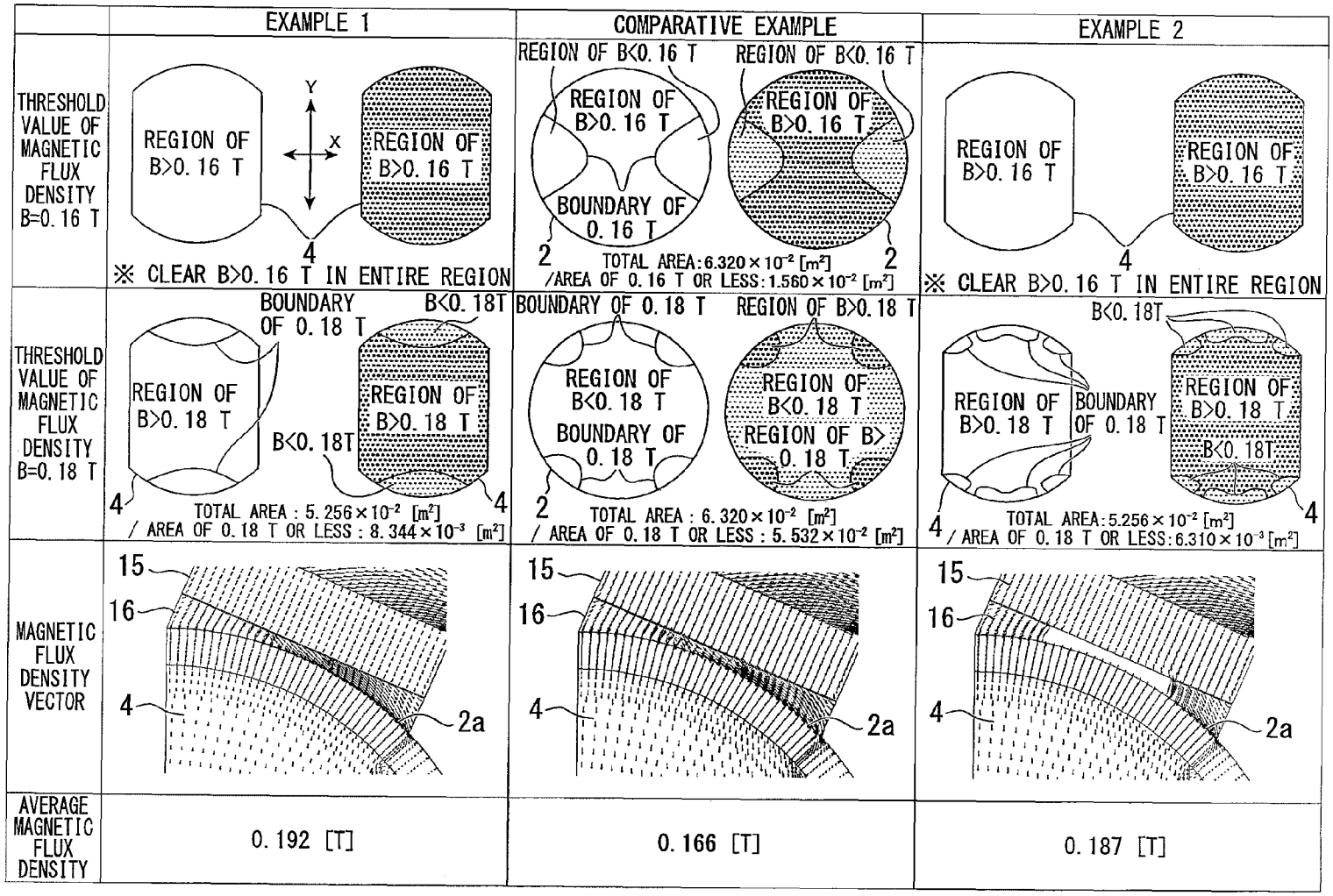
FIG. 12 is a diagram illustrating a variation in magnetic flux density in the housing in Example 1, Example 2, and the comparative example.

The magnetic flux density is simulated on examples of the present invention and a comparative example, and the simulation results are shown in FIGS. 11 and 12.

The basic configuration of the examples and the comparative example was the same as the magnetic-separation filter device 1 according to the above-mentioned embodiment. A simulation was performed by using a configuration in which the area ratio of the outer region 5 relative to the inner region 4 is set to 1:7 as shown in (1) of FIG. 8 and a pair of partition plates 3 is provided as Example 1, by using a configuration in which the laminated electromagnetic steel sheet of the central portion in the width direction of the teeth 16 is cut out (cut out by a length corresponding to a half in the circumferential direction) as Example 2 as shown in (5) of FIG. 9, and by using a configuration in which no partition plate 3 is provided as a comparative example.

Regarding measurement of a magnetic flux density in FIG. 11, the magnetic flux density [T] (Tesla) was measured at the intervals shown in Table 1 and Table 2 using the radius direction centered on the center O of the housing 2 and perpendicular to the partition plates 3 in the inner region 4 as the X direction and using the length direction (the direction of the magnetic path 16) of the inner region 4 perpendicular to the X direction as the Y direction.

TABLE 1

| X direction | | | | | |
|---|---|---|---|---|---|
| Example 1 | | Comparative Example | | Example 2 | |
| X [mm] | B [T] | X [mm] | B [T] | X [mm] | B [T] |
| 0.0 | 0.195 | 0.0 | 0.165 | 0.0 | 0.188 |
| 4.3 | 0.195 | 4.3 | 0.165 | 4.3 | 0.188 |
| 8.6 | 0.195 | 8.6 | 0.165 | 8.6 | 0.188 |
| 12.9 | 0.195 | 12.9 | 0.164 | 12.9 | 0.188 |
| 17.1 | 0.195 | 17.1 | 0.164 | 17.1 | 0.188 |
| 21.4 | 0.195 | 21.4 | 0.164 | 21.4 | 0.188 |
| 25.7 | 0.195 | 25.7 | 0.164 | 25.7 | 0.189 |
| 30.0 | 0.196 | 30.0 | 0.163 | 30.0 | 0.189 |
| 34.3 | 0.196 | 34.3 | 0.163 | 34.3 | 0.189 |
| 38.6 | 0.196 | 38.6 | 0.162 | 38.6 | 0.189 |
| 42.9 | 0.197 | 42.9 | 0.162 | 42.9 | 0.189 |
| 47.1 | 0.197 | 47.1 | 0.161 | 47.1 | 0.189 |
| 51.4 | 0.198 | 51.4 | 0.160 | 51.4 | 0.190 |
| 55.7 | 0.198 | 55.7 | 0.160 | 55.7 | 0.190 |
| 60.0 | 0.198 | 60.0 | 0.159 | 60.0 | 0.190 |
| 64.4 | 0.199 | 64.4 | 0.157 | 64.4 | 0.190 |
| 68.8 | 0.199 | 68.8 | 0.156 | 68.8 | 0.191 |
| 73.2 | 0.200 | 73.2 | 0.155 | 73.2 | 0.191 |
| 77.6 | 0.200 | 77.6 | 0.153 | 77.6 | 0.191 |
| 82.0 | 0.201 | 82.0 | 0.152 | 82.0 | 0.191 |

TABLE 1-continued

| X direction | | | | | |
|---|---|---|---|---|---|
| Example 1 | | Comparative Example | | Example 2 | |
| X [mm] | B [T] | X [mm] | B [T] | X [mm] | B [T] |
| 86.4 | 0.201 | 86.4 | 0.150 | 86.4 | 0.191 |
| 90.8 | 0.201 | 90.8 | 0.148 | 90.8 | 0.191 |
| 95.2 | 0.201 | 95.2 | 0.146 | 95.2 | 0.192 |
| 98.8 | 0.201 | 98.8 | 0.144 | 98.8 | 0.192 |
| 101.0 | 0.202 | 101.0 | 0.142 | 101.0 | 0.192 |
| 102.4 | 0.202 | 102.4 | 0.142 | 102.4 | 0.192 |
| | | 103.7 | 0.141 | | |
| | | 105.1 | 0.140 | | |
| | | 106.4 | 0.139 | | |
| | | 110.3 | 0.137 | | |
| | | 114.3 | 0.134 | | |
| | | 118.2 | 0.131 | | |
| | | 122.1 | 0.128 | | |
| | | 126.1 | 0.126 | | |
| | | 130.0 | 0.123 | | |
| | | 133.9 | 0.120 | | |
| | | 137.9 | 0.117 | | |
| | | 139.2 | 0.115 | | |
| | | 140.5 | 0.114 | | |
| | | 141.9 | 0.114 | | |

TABLE 2

| Y direction | | | | | |
|---|---|---|---|---|---|
| Example 1 | | Comparative Example | | Example 2 | |
| X [mm] | B [T] | X [mm] | B [T] | X [mm] | B [T] |
| 0.0 | 0.195 | 0.0 | 0.165 | 0.0 | 0.188 |
| 3.8 | 0.195 | 3.8 | 0.165 | 3.8 | 0.188 |
| 7.6 | 0.194 | 7.6 | 0.165 | 7.6 | 0.188 |
| 11.4 | 0.194 | 11.4 | 0.165 | 11.4 | 0.188 |
| 15.2 | 0.194 | 15.2 | 0.165 | 15.2 | 0.188 |
| 19.0 | 0.194 | 19.0 | 0.165 | 19.0 | 0.188 |
| 22.9 | 0.194 | 22.9 | 0.165 | 22.9 | 0.188 |
| 26.7 | 0.194 | 26.7 | 0.166 | 26.7 | 0.188 |
| 30.5 | 0.193 | 30.5 | 0.166 | 30.5 | 0.188 |
| 34.3 | 0.193 | 34.3 | 0.166 | 34.3 | 0.187 |
| 38.1 | 0.193 | 38.1 | 0.167 | 38.1 | 0.187 |
| 41.9 | 0.192 | 41.9 | 0.167 | 41.9 | 0.187 |
| 45.7 | 0.192 | 45.7 | 0.167 | 45.7 | 0.187 |
| 49.5 | 0.191 | 49.5 | 0.168 | 49.5 | 0.187 |
| 53.3 | 0.191 | 53.3 | 0.168 | 53.3 | 0.186 |
| 57.1 | 0.190 | 57.1 | 0.168 | 57.1 | 0.186 |
| 61.0 | 0.189 | 61.0 | 0.169 | 61.0 | 0.186 |
| 64.8 | 0.189 | 64.8 | 0.169 | 64.8 | 0.186 |
| 68.6 | 0.188 | 68.6 | 0.169 | 68.6 | 0.185 |
| 72.4 | 0.187 | 72.4 | 0.169 | 72.4 | 0.185 |
| 76.2 | 0.186 | 76.2 | 0.170 | 76.2 | 0.185 |
| 80.0 | 0.185 | 80.0 | 0.170 | 80.0 | 0.184 |
| 86.5 | 0.183 | 86.5 | 0.170 | 86.5 | 0.184 |
| 93.0 | 0.181 | 93.0 | 0.170 | 93.0 | 0.183 |
| 99.4 | 0.179 | 99.4 | 0.170 | 99.4 | 0.182 |
| 105.9 | 0.177 | 105.9 | 0.170 | 105.9 | 0.182 |
| 112.4 | 0.175 | 112.4 | 0.169 | 112.4 | 0.181 |
| 118.9 | 0.173 | 118.9 | 0.168 | 118.9 | 0.181 |
| 125.4 | 0.170 | 125.4 | 0.167 | 125.4 | 0.180 |
| 131.9 | 0.167 | 131.9 | 0.166 | 131.9 | 0.180 |
| 136.9 | 0.166 | 136.9 | 0.165 | 136.9 | 0.180 |
| 139.9 | 0.164 | 139.9 | 0.164 | 139.9 | 0.179 |
| 141.9 | 0.164 | 141.9 | 0.164 | 141.9 | 0.179 |

In the measurement results shown in FIGS. 11(*a*) and 11(*b*), the magnetic flux densities in both Example 1 and Example 2 in the X direction were higher than that in the comparative example. Particularly, in the X direction (width direction), the magnetic flux density increased as nearing the end. The magnetic flux densities in both Example 1 and Example 2 in the Y direction were higher than that in the comparative example. Example 1 exhibited a tendency of the magnetic flux density to decrease and become closer to that in the comparative example as departing from the center.

In FIG. 12, the magnetic flux densities in both Examples 1 and 2 were higher than the threshold value 0.16 T and were higher than 0.18 except both ends. In Example 2, the distribution of the magnetic flux density was equalized. On the contrary, the magnetic flux density in the comparative example was lower than those in Examples 1 and 2.

In the magnetic-separation filter device 1 according to the embodiment, fluids such as oil is controlled to flow in the outer region 5 defined by the partition plates 3 of the housing 2 from the inlet 11, to descend therein, to be reversed at the lower end of the partition plates 3, and to ascend in the inner region 4, whereas a configuration in which fluids such as oil is controlled to flow in the housing 2 from the backwash liquid outlet 6, to ascend in the inner region 4, and to be discharged from the outlet 12 may alternatively be used.

In the above-mentioned embodiment, the permanent magnets 15 are connected to both ends of the yokes 14 having a substantially semicircular shape and two permanent magnets 15 are disposed in each arc-like portion 2*a* as opposed to the inner region 4 filled with the fine amorphous-alloy wire bundle 9, but the permanent magnets 15 used in the present invention are not confined to this configuration, and for example, only one permanent magnet may be disposed on each side. Alternatively, an even number of permanent magnets may be disposed in each of the yokes 14.

Materials of the yokes 14 are not confined to a laminated electromagnetic steel sheet, but may be formed of ferrite or the like.

INDUSTRIAL APPLICABILITY

The present invention relates to a magnetic-separation filter device that can remove inflow contaminants of fine ferromagnetic particles from a process fluid even under a high pressure and a high temperature in a process plant or the like. Hence, the present invention can be applied to a high-pressure fluid as well as to a normal-pressure fluid so as to adsorb ferromagnetic contaminants with high efficiency.

REFERENCE SIGNS LIST

1: magnetic-separation filter device
2: housing
3: partition plate
4: inner region
5: outer region
8*a*, 8*b*: support fitting
9: fine amorphous-alloy wire bundle
11: inlet
12: outlet
14: yoke
15: permanent magnet
16: teeth
18: on-off driver
20: air cylinder
29: filter differential pressure meter
31: integration flowmeter
33: controller
34: timer
35: determination section

The invention claimed is:

1. A magnetic-separation filter device that removes magnetic particles from a fluid containing the magnetic fine particle contaminants, comprising:

a substantially cylindrical housing;

two partition plates that are disposed in an inside of the housing so as to extend in a vertical direction of the housing, dividing the inside of the housing by being disposed in parallel to each other;

a filter medium that includes a fine amorphous-alloy wire bundle filled in a first region defined by the housing and the two partition plates; and a plurality of permanent magnets that are provided on both sides of the first region outside the housing, wherein the contaminants of ferromagnetic fine particles are adsorbed on the filter media by flowing the fluid containing such contaminants through the first region in which a magnetic field has been formed by the permanent magnets.

2. The magnetic-separation filter device according to claim 1, further comprising a yoke that is formed of a material having high magnetic permeability and is connected as a return magnetic path to the permanent magnet.

3. The magnetic-separation filter device according to claim 2, further comprising an on-off driver that causes the yoke and the permanent magnet to be opposable to and separable from the housing.

4. The magnetic-separation filter device according to claim 3, wherein an on-off control between opposed arrangement and separated arrangement of the yoke and the permanent magnet with respect to the housing by the on-off driver is determined on the basis of one or more pieces of data on a magnetization time by a timer, a differential pressure between upstream and downstream of the filter medium, and an integrated flow volume of the fluid passing through the filter medium.

5. The magnetic-separation filter device according to claim 1, further comprising teeth that are formed of a material having high magnetic permeability and having no residual magnetism and are disposed between the permanent magnet and the first region of the housing, wherein a contact surface of the teeth and the permanent magnet is planar.

6. The magnetic-separation filter device according to claim 5, wherein a part of the central portion of the teeth is cut out.

7. The magnetic-separation filter device according to claim 1, wherein a fluid including contaminants to be adsorbed on the filter medium flows upward in the first region defined by the housing and the partition plate and filled with fine amorphous-alloy wire bundle.

8. The magnetic-separation filter device according to claim 7, wherein a fluid including contaminants to be adsorbed on the filter medium descends and is reversed in flow direction in a second region defined by the housing and the partition plate and then ascends in the first region.

9. The magnetic-separation filter device according to claim 1, wherein one or more permanent magnets are arranged to oppose the first region of the housing defined by the partition plate.

10. The magnetic-separation filter device according to claim 1, further comprising a plurality of magnetic-separation filters connected in parallel, wherein the magnetic-separation filters are controlled such as to alternately transmit a backwash fluid at timings not overlapping with each other and to perform a filtration at continuous mode.

* * * * *